United States Patent [19]

Bullis

[11] 3,955,299

[45] May 11, 1976

[54] ADJUSTABLE MEANS TO VARY POINT OF IMPACT OF OVER-AND-UNDER FIREARMS

[75] Inventor: Douglas E. Bullis, Ilion, N.Y.

[73] Assignee: Remington Arms Company, Inc., Bridgeport, Conn.

[22] Filed: Sept. 5, 1974

[21] Appl. No.: 503,342

[52] U.S. Cl. ..... 42/1 R; 42/1 S; 42/76 R; 89/41 A

[51] Int. Cl.[2] ..... F41C 21/06; F41G 3/00

[58] Field of Search ..... 42/1 R, 1 S, 76 R, 75 A; 89/41 A

[56] References Cited

UNITED STATES PATENTS

| | | | |
|---|---|---|---|
| 1,285,253 | 11/1918 | Lepak | 89/41 A |
| 2,949,825 | 8/1960 | Musser et al. | 89/41 A |
| 3,098,410 | 7/1963 | Giza | 89/41 A |
| 3,353,291 | 11/1967 | Musser | 42/1 S |
| 3,550,300 | 12/1970 | Roder | 42/1 R |

FOREIGN PATENTS OR APPLICATIONS

| | | | |
|---|---|---|---|
| 152,815 | 2/1963 | U.S.S.R. | 42/1 S |

*Primary Examiner*—Charles T. Jordan

*Attorney, Agent, or Firm*—John H. Lewis, Jr.; Nicholas Skovran

[57] ABSTRACT

An adjustable means connecting the muzzle ends of barrels in an over-and-under firearm, which adjustable means when actuated causes a separation of the barrels, thus altering the point of impact of projectile means discharged from the barrels which have been moved.

12 Claims, 6 Drawing Figures

ADJUSTABLE MEANS TO VARY POINT OF IMPACT OF OVER-AND-UNDER FIREARMS

The present invention relates to an adjustable means to vary the point of impact of projectiles discharged from the lower barrel of superimposed gun barrels relative to the sighting line of the firearm. More particularly, it relates to a connecting means on the muzzle ends of said barrels which include adjustable means to move the muzzle ends of said lower barrels away from the line of sight of the firearm.

The use of over-and-under shotguns wherein one barrel is superimposed directly over a second barrel is not new and there are many patents on such guns going back many years. These over-and-under shotguns remain popular today and are frequently used in the shooting sports such as trap and skeet. The present invention is particularly useful for over-and-under shotguns used in the game of trap.

Trap is a shooting sport where a shooter occupies in turn each of five shooting positions located on a segment of a circle. Targets are projected forwardly and at angles from a target throwing machine positioned at a point forwardly of the shooting position so that the target is moving away from and in most cases at an angle from the shooter. A single target may be thrown or two targets (doubles) may be thrown simultaneously. Doubles shooting presents particular problems because each of the targets is moving away from the shooter at a fast and different rate. Because of the known angle feature of the trap layout, all good doubles shooters plan to shoot the first target several yards ahead of or before the spot where they generally break their single targets. This enables the shooters to complete their swing across to the second target while it is still in effective range for their shot patterns. As an arbitrary figure for charting purposes used by the assignee of the present invention, if the first target is broken at 17 yards in flight, the second target should be broken at about 25 yards in flight.

Each individual shooter has his own preference as to where the point of impact should be at a given yardage in relation to the point of aim. One shooter may like this point of impact to be 6 inches low at 40 yards, while another shooter may want it to be 10 inches high. When one buys a gun, he must get used to the point of impact of that particular gun, which usually varies with each gun. The adjustable means of the present invention allows each individual to find the point that he likes and to adjust the gun to himself, not adjust himself to the gun.

Obviously, each shooter determines for himself when he prefers to shoot at the first target before swinging the gun over the second target. If the shooter tends to shoot at the first target late, the second target may have reached its apex and is on its way down. Thus, it is understandable that a shooter's individual shooting habits will vary and the amount of lead required for the first and second targets will vary.

The present invention has as its object an adjustable means on the muzzle ends of the barrels which allows the shooter a variable point of impact of the bottom barrel relative to the line of sight of the firearm.

Another object of the invention is to provide a device connected to the muzzle ends of both barrels which can be adjusted to move said barrels away from each other wherein the point of impact of the upper barrel is varied a minor degree while the point of impact of the lower barrel is varied an appreciable or significant degree.

Still another object is to provide a barrel band connecting the muzzle ends of both barrels including a cam adjustable means to force the lower barrel away a greater distance from its normal position than the upper barrel is moved, thus varying the point of impact of said barrels with the point of impact of the lower barrel being changed significantly more than the point of impact of the upper barrel.

Still another object of the invention is to provide markings on said adjustable means which will permit a shooter to know how his barrels are set.

Other objects and advantages will become apparent from the following description taken in conjunction with the accompanying drawing in which.

The present invention has for its broad concept a device which holds the forward or muzzle ends of over-and-under gun barrels together while providing an adjusting means thereon to move said barrels away from each other, in order to vary the point of impact of the lower barrel a significant amount while varying the point of impact of the upper barrel a somewhat lesser amount.

Two embodiments of the invention are disclosed. The first and preferred embodiment utilizes a cam means connected to and interposed between the upper and lower barrels and an adjusting means to actuate the cam means to move one end of said barrels away from the other barrel.

A second embodiment utilizes a threaded stud extending downwardly from the upper barrel and a second threaded stud extending upwardly from the lower barrel to screw into an adjusting wheel. Upon rotation of the adjusting wheel, although the more rigid barrel is moved a relatively minor distance, the less rigid barrel moves away from the more rigid barrel a relatively substantially greater distance.

Figure 1:
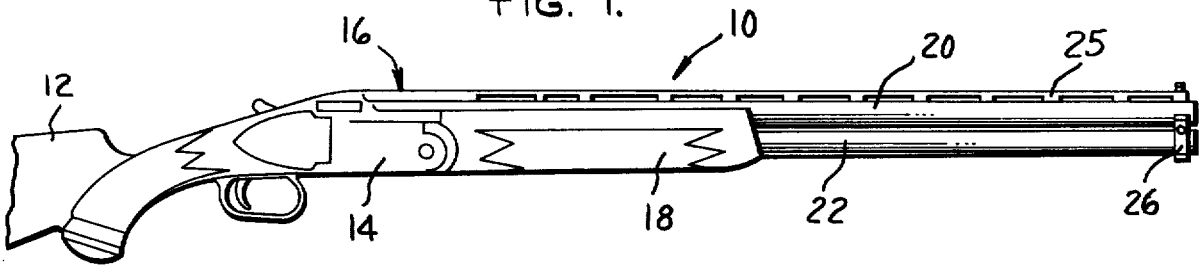
FIG. 1 is a side view of an over-and-under shotgun showing an adjustable barrel band means at the muzzle ends of said barrels.

FIG. 1 shows a commercial over-and-under shotgun 10 available on the market today. The shotgun includes a wooden stock 12, a metal frame assembly 14, a barrel assembly 16, and a fore-end 18. The barrel assembly includes an upper barrel 20 and a lower barrel 22 which are connected at its forward or muzzle end by an adjustable barrel band means 26, which is one of the embodiments of the present invention. Mounted on top of the upper barrel 20 is a ventilated rib 25 which tends to stiffen the upper barrel as the vent rib is brazed securely to the top barrel to make it into a rigid trussed member.

Figure 2:
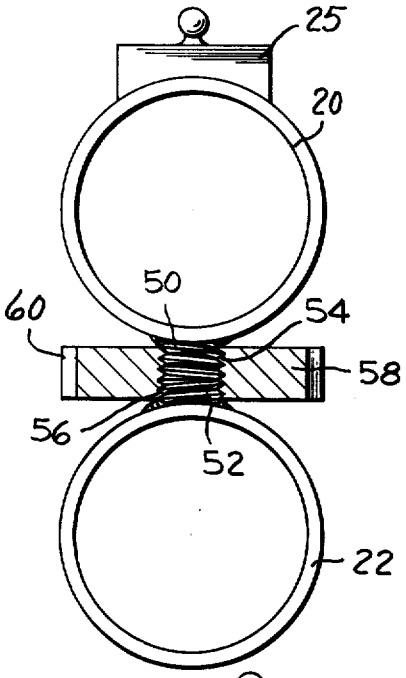
FIG. 2 depicts a front view showing superimposed barrels and one embodiment of the invention with an adjusting wheel to vary the point of impact of the lower barrel relative to the line of sight of the firearm.
Figure 3:
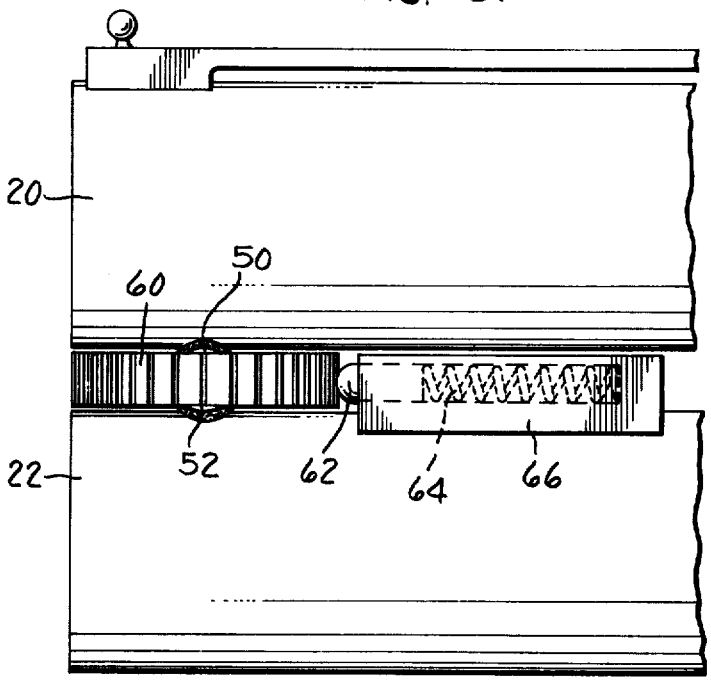
FIG. 3 is an enlarged side view of the muzzle end of the superimposed barrels and adjusting wheel embodiment shown in FIG. 2.
Figure 4:
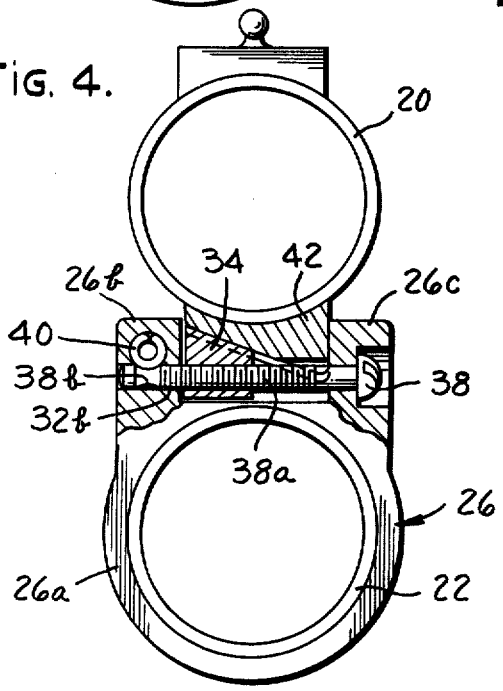
FIG. 4 is a front view of over-and-under barrels and a preferred embodiment of adjustable cam means to vary the point of impact of the lower barrel relative to the line of sight of the firearm.
Figure 5:
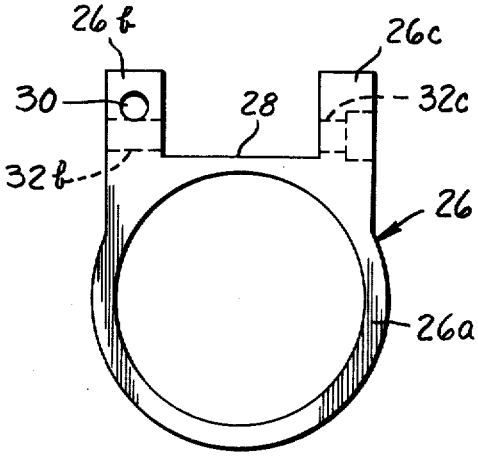
FIG. 5 shows a front view of the barrel band which encircles the lower barrel of the embodiment shown in FIG. 4.
Figure 6:
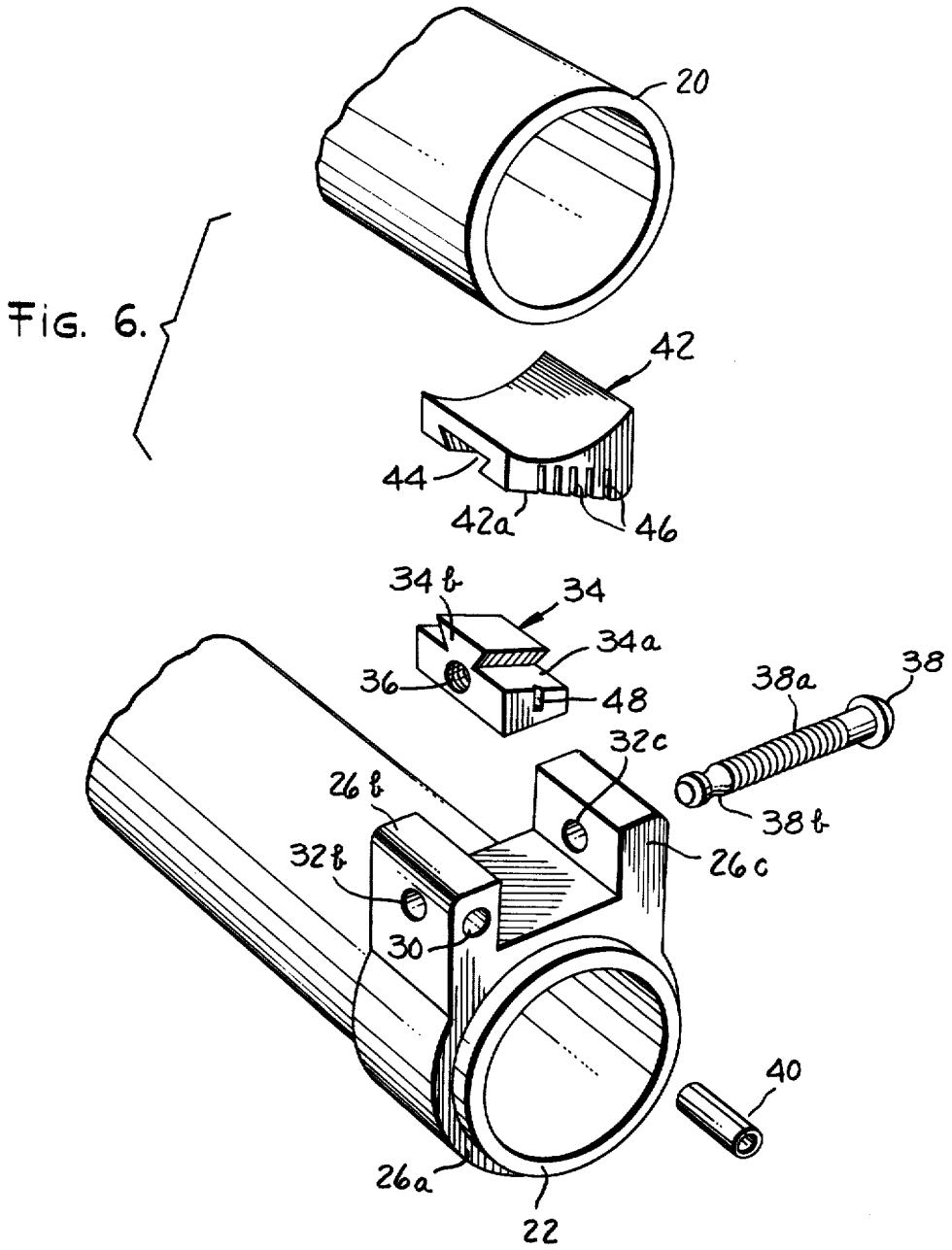
FIG. 6 is an isometric, exploded view of the embodiment shown in FIG. 4.

In carrying the invention into practice, it is preferred to utilize the design shown in FIGS. 4–6. FIGS. 2 and 3 show an alternate design which will be explained in detail below.

Referring to FIGS. 4–6, a barrel band 26 is shown attached to the lower barrel 22 by a slip fit or some other appropriate method.

Barrel band 26 comprises an annular band 26*a* which encircles the lower barrel and two upstanding lugs 26*b* and 26*c*. A slot 28 is formed between lugs 26*b* and 26*c*. An axial opening 30 is provided in one of the lugs and transverse openings 32*b* and 32*c* are provided in lugs 26*b* and 26*c*.

A slide member 34 has a transverse threaded opening 36 which is in alignment with openings 32*b* and 32*c* of the barrel band. An adjustable barrel band screw 38 has a centrally located threaded portion 38*a* and an annular concave groove 38*b* at the forward portion thereof. The outside diameter of the thread on screw 38 is less than the diameter of the openings 32*b* and 32*c* in the lugs and thus does not engage the lugs 26*b* and 26*c*. The threaded portion 38*a* of the barrel band screw does engage the threaded opening 36 of a slide member 34. After the barrel band screw is pinned in place by means of a pin 40, (see FIG. 4) the screw can rotate but cannot move in or out of the barrel band. By screwing the barrel band screw clockwise or counterclockwise, the slide member 34 can be made to move on said barrel band screw within the limits set by the slot 28.

Still referring to FIGS. 4 & 6, stud 42 is shown brazed or otherwise attached to the lower portion of the upper barrel 20. Stud 42 has an inclined face 42*a* which complements an inclined face 34*a* on slide member 34. Slide member 34 is slidably mounted on stud 42 by way of a dovetail means. The dovetail holds the two barrels together. FIG. 6 shows the stud 42 having a groove 44 and slide member 34 having a male portion 34*b* which is inserted into groove 44 to form the dovetail means. The width of member 42 is such that it forms a slip fit within slot 28 and is movable in a vertical direction therein by actuation of screw 38. There is no sideways motion, but the bottom barrel moves away from the top barrel in a straight line so the bottom barrel won't shoot right or left when adjusted.

From the above explanation, it can be understood that when screw 38 is turned, the to-and-fro motion of the slide caused by the turning of the screw threads causes the up-and-down motion of the stud and slide due to the wedging or camming action between the slide and the stud.

Vernier markings 46 and 48 on the stud and the slide member assure resetting of the barrel band to a predetermined position by the shooter.

This design allows each barrel to expand or elongate independently so as not to affect the point of impact.

The second embodiment as disclosed in FIGS. 2 and 3 utilizes a twin buckle device consisting of a top threaded stud 50 projecting downwardly from the lower part of the upper barrel 20 and a bottom threaded stud 52 projecting upwardly from the bottom barrel 22. One of said threaded studs has a right hand thread and the other stud has a left hand thread. The threaded studs are threaded into correspongingly threaded openings 54 and 56 terminating at the center of an adjusting wheel 58 which is shown in a horizontal position between the upper and lower barrels in FIG. 2.

A series of indexing notches 60 are located around the periphery of the adjusting wheel.

It should be understood that the barrels are separated or closed by turning the adjusting wheel. The adjusting wheel is held in position by a detent 62 which is biased toward said indexing notches 60 of the adjusting wheel by a detent spring 64 which is located in a housing 66 mounted on one of the barrels. FIG. 3 shows the housing 66 on the lower barrel but obviously it could be mounted on the upper barrel.

The indexing notches of the second embodiment and the vernier markings of the first embodiment accomplish the same result, i.e. permits the shooter to reset the point of impact of his barrels to a predetermined position.

Firing tests made with shotguns utilizing both of the embodiments explained above have confirmed that the point of impact of both barrels can be adjusted vertically. As explained above, because the upper barrel has a rib mounted thereon, it tends to be more rigid than the lower barrel and thus the upper barrel does not move to the same degree as the bottom barrel. Obviously, if for some reason it should be desired to make the bottom barrel more rigid, the upper barrel would be expected to move a greater amount relative to the bottom barrel.

In order to show the degree to which the point of impact of the two barrels varies when the adjusting means of the two embodiments of the invention are utilized, a 40 yard point-of-impact test was conducted. In the embodiment shown in FIGS. 2 and 3, i.e. the adjusting wheel, the point of impact of projectiles fired from the top barrel had a maximum spread of 2.46 inches at 40 yards. The point of impact of the lower barrel had a spread of 5.50 inches at 40 yards.

In the embodiment of FIGS. 4–6, i.e. the camming adjusting means, the point of impact on the top barrel had a maximum spread of 1.86 inches at the bottom barrel had a spread of 6.14 inches.

What is claimed is:

1. In a double-barrel firearm in which an upper barrel is superimposed over a lower barrel, an adjustable means connecting said upper and lower barrels for varying the point of impact of projectile means fired from said lower barrel relative to the line of sight of said firearm, said adjustable means comprising a turn buckle device consisting of one right hand stud fastened to one of the barrels and one left hand stud fastened to the other of said barrels, said studs being held together with an adjusting wheel in the center, said adjusting wheel having a right hand and a left hand thread which terminate at the center of the wheel and which cooperate with the corresponding stud thus causing the barrels to be separated or closed depending on the direction that the adjusting wheel is turned.

2. In a double-barrel firearm as recited in claim 1, wherein a plurality of notches is provided along the periphery of said adjusting wheel, and spring biased detent means for engaging said notches as the adjusting wheel is turned so that the adjusting wheel can be held in any predetermined position.

3. In a double-barrel firearm in which an upper barrel is superimposed over a lower barrel, an adjustable means connecting said upper and lower barrels for varying the point of impact of projectile means fired from said lower barrel relative to the line of sight of said firearm, said adjustable means comprising a camming means positioned between the upper and lower barrels, means for actuating said camming means to move said barrels away from each other, said camming means comprising a stud attached to said upper barrel and projecting downwardly therefrom, said stud having an inclined cam face thereon, a barrel band mounted on said lower barrel, a slide means having an inclined cam face which complements the inclined cam face of the stud, and adjusting means for moving said slide means in camming position against said stud to force at least one of said barrels away from the other barrel.

4. In a double-barrel firearm as recited in claim 3, wherein said adjustable means comprises an adjusting screw positioned in said barrel band transversely of and between said barrels in a manner which permits the adjusting screw to rotate free of said barrel band, means preventing lateral movement of said adjusting screw while permitting rotational movement, and a threaded opening in said slide means in which said adjusting screw is screwed, whereupon by selectively actuating the adjusting screw said slide means is caused to slide in said barrel band and depending on the direction the adjusting screw is rotated, to move at least one of said barrels away from or towards the other barrel.

5. An over-and-under firearm in which one gun barrel is superimposed above a second barrel, an adjusting means interposed between and connected to said barrels for selectively moving the lower barrel relative to said upper barrel thus changing the point of impact of projectile means fired from the lower barrel relative to the line of sight of said firearm, said adjusting means comprising a top stud fastened to the lower part of said top barrel and a bottom stud fastened to the upper part of said lower barrel, said studs being threaded, one of said studs having a right hand thread and the other stud having a left hand thread, adjusting wheel having a central opening therein having an upper threaded portion and a lower threaded portion, both of said threaded portions terminating at the center of said adjusting wheel, one of said threaded portions of said wheel opening having a right hand thread and the other threaded portion of said opening having a left hand thread to co-operate with the thread on a corresponding stud, said studs being screwed into said opening to effect a connection of said studs through said adjusting wheel, so that upon rotation of said adjusting wheel, said studs are free to move in or out depending on the direction of rotation of said wheel, thus moving said barrels apart from each other.

6. An over-and-under firearm as recited in claim 5, wherein said upper barrel is made more rigid than said lower barrel so that upon rotation of said adjusting wheel, said lower barrel is moved a greater amount than said upper barrel.

7. An over-and-under firearm as recited in claim 6, wherein means are provided for securing said adjusting wheel in predetermined position and for identifying said position as it relates to the relative position of said upper and lower barrels.

8. An over-and-under firearm as recited in claim 7, in which said adjusting wheel securing and identifying means comprises a plurality of identifiable notches in said adjusting wheels and spring detent means for engaging said notches when the wheel is in various positions of rotation.

9. An over-and-under firearm in which one gun barrel is superimposed above a second gun barrel, an adjusting means interposed between and connected to said barrels for selectively moving the lower barrel relative to said upper barrel thus changing the point of impact of projectile means fired from the lower barrel relative to the line of sight of said firearm, said adjusting means comprising a barrel band attached to said bottom barrel, said barrel band having a pair of upstanding, spaced lugs forming a slot therebetween, a downwardly projecting stud attached to said upper barrel, said stud having an inclined cam face, a slide member having a cam face which engages the cam face of said stud, means connecting said slide member and said stud, and adjusting means for moving said slide member in said slot transversely of the longitudinal direction of said barrels to cam against said stud.

10. An over-and-under firearm as recited in claim 9, wherein said means connecting said slide member and said stud comprises a dovetail connection which provides movement of the slide member and stud in one direction without appreciable side movement.

11. An over-and-under firearm as recited in claim 9, wherein said adjusting means comprises an elongated screw means extending through one of said upstanding lugs of the barrel band to threadly engage said slide member and enter at least partially into said other lug, means preventing removal of said elongated screw means while permitting rotation thereof, whereupon movement of said screw means will cause the slide member to move along said barrel band slot depending on the direction of rotation of said screw means to cam against said lug.

12. An over-and-under firearm as recited in claim 9, wherein means are provided on said stud and said slide member for identifying the relative position of said barrels.

* * * * *

UNITED STATES PATENT OFFICE

CERTIFICATE OF CORRECTION

PATENT NO. : 3,955,299

DATED : MAY 11, 1976

INVENTOR(S) : DOUGLAS E. BULLIS

It is certified that error appears in the above-identified patent and that said Letters Patent are hereby corrected as shown below:

Col. 1, Line 54, after "over" insert --to--. Col. 2, Line 48, after "one" delete --end--. Col. 3, Line 24, after "of" delete --a--. Col. 4, Line 37 "on" should read as "of"; Col. 4, Line 38, "at" should read as "while". Col. 5, Line 35, after "thread", insert --an--.

Signed and Sealed this

Nineteenth Day of October 1976

[SEAL]

*Attest:*

RUTH C. MASON
*Attesting Officer*

C. MARSHALL DANN
*Commissioner of Patents and Trademarks*